US009076390B2

(12) United States Patent
Kaplan et al.

(10) Patent No.: US 9,076,390 B2
(45) Date of Patent: Jul. 7, 2015

(54) DISPLAY DEVICE AND DISPLAY DEVICE DRIVING METHOD

(71) Applicant: Samsung Display Co., Ltd., Yongin, Gyeonggi-Do (KR)

(72) Inventors: Leonid Kaplan, Yongin (KR); Heung-Yeol Na, Yongin (KR); Baek-Woon Lee, Yongin (KR); Won-Sik Hyun, Yongin (KR); Jae-Hoon Lee, Yongin (KR)

(73) Assignee: SAMSUNG DISPLAY CO., LTD. (KR)

( * ) Notice: Subject to any disclaimer, the term of this patent is extended or adjusted under 35 U.S.C. 154(b) by 82 days.

(21) Appl. No.: 14/040,941

(22) Filed: Sep. 30, 2013

(65) Prior Publication Data

US 2014/0347402 A1 Nov. 27, 2014

(30) Foreign Application Priority Data

May 22, 2013 (KR) ..... 10-2013-0057928

(51) Int. Cl.
*G09G 3/34* (2006.01)
*G09G 3/36* (2006.01)

(52) U.S. Cl.
CPC ..... *G09G 3/3413* (2013.01); *G09G 2310/0245* (2013.01); *G09G 3/34* (2013.01); *G09G 2310/061* (2013.01); *G09G 2310/063* (2013.01); *G09G 3/3607* (2013.01); *G09G 2310/0235* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,809,482 | B2 | 10/2004 | Koyama | |
| 2003/0122494 | A1 * | 7/2003 | Ide | 315/169.3 |
| 2003/0174106 | A1 * | 9/2003 | Tanada et al. | 345/83 |
| 2005/0078061 | A1 * | 4/2005 | Kim et al. | 345/63 |

FOREIGN PATENT DOCUMENTS

| | | | |
|---|---|---|---|
| KR | 1020060114993 | A | 11/2006 |
| KR | 1020070000163 | A | 1/2007 |
| KR | 101084237 | B1 | 11/2011 |
| KR | 1020110123952 | A | 11/2011 |

OTHER PUBLICATIONS

A. Tagawa et al., "A Novel Digital-Gray-Scale Driving Method with a Multiple Addressing Sequence for AM-OLED Displays", Sharp Corporation, Japan, AMD3/OLED5-2, 2004, pp. 279-282.

* cited by examiner

*Primary Examiner* — Linh N Hoffner
(74) *Attorney, Agent, or Firm* — Cantor Colburn LLP

(57) ABSTRACT

A display device includes a display unit including pixels, each of which emits light according to data voltages, respectively; and a timing controller which divides an area of the display unit into an upper, center and bottom portions, divides one frame time into light emission sub-frames of a light emission period and a blank sub-frame of a blank period in which is supplied a black data signal, divides the upper, center and the bottom portions into groups, differentiates a scan start time of a light emission sub-frame and a scan start time of the blank sub-frame of each group, and increases the light emission period and decreases the blank period in proportional to an increase ratio of the light emission period as a group is closer to a middle of the center portion.

19 Claims, 13 Drawing Sheets

DISPLAY DEVICE AND DISPLAY DEVICE DRIVING METHOD

This application claims priority to Korean Patent Application No. 10-2013-0057928, filed on May 22, 2013, and all the benefits accruing therefrom under 35 U.S.C. §119, the entire contents of which are incorporated herein by reference.

BACKGROUND (a) Field

The invention relates to a display device and a driving method of the display device. More particularly, the invention relates to a method for effectively reducing luminance imbalance of a display device due to a voltage drop of the display device using an organic light emitting diode.

(b) Description of the Related Art

In recent years, various flat panel displays capable of effectively reducing weight and volume which are demerits of a cathode ray tube have been developed. The flat panel displays include a liquid crystal display ("LCD"), a field emission display ("FED"), a plasma display panel ("PDP"), and an organic light emitting diode ("OLED") display.

Among the flat panel displays, the OLED display, which displays an image using an OLED generating light by recombination of electrons and holes, is driven at low power consumption while having a rapid response speed and is excellent in emission efficiency, luminance, and viewing angle.

In general, a plurality of pixels emitting light in the OLED displays include OLEDs, and each OLED emits light with predetermined luminance corresponding to a data current supplied from a pixel circuit.

As one gray expression method of an OLED display, digital driving controls time during which an OLED of a pixel is turned on. In an OLED display emitting light using the digital driving method, one frame is divided into a plurality of sub-frames, and a light emission period of each sub-frame is appropriately set for gray expression. Pixels emit light during a sub-frame selected according to an image signal for gray expression among a plurality of sub-frames that forms one frame.

SUMMARY

The invention has been made in an effort to effectively reduce luminance imbalance due to a voltage drop caused by extension of a power line of a display device.

A display device according to an exemplary embodiment of the invention includes a display unit including a plurality of pixels, each emitting light according to each of a plurality of data voltages, a timing controller dividing an area of the display unit into an upper portion, a center portion and a bottom portion, dividing one frame time into a plurality of light emission sub-frames of a light emission period and a blank sub-frame of a blank period supplying a black data signal, and generating an image data signal corresponding to each of the plurality of sub-frames, and a data driver applying a data voltage corresponding to the image data signal to the display unit, and the timing controller divides the upper portion into at least three groups including first to third groups, the center portion into at least four groups including fourth to seventh groups, and the bottom portion into at least eighth to tenth groups and differentiates a scan start time of a light emission sub-frame and a scan start time of the blank sub-frame of each group, and increases the light emission period of a group of the first to the tenth groups and decrease the blank period of the group of the first to the tenth groups in proportional to an increase ratio of the light emission period as the group of the first to the tenth groups is closer to a middle of the center portion.

The timing controller may order the emission period before the blank period in the plurality of sub-frames, and sequentially delays scan start times of the second to fifth groups with reference to a scan start time of the first sub-frame of the first group and sequentially delays scan start times of the seventh to tenth groups with reference to a scan start time of the first sub-frame of the sixth group.

The scan start time of the first sub-frame of the first group may be behind the scan start time of the first sub-frame of the sixth group.

In addition, the timing controller may order the light emission period before the blank period in the plurality of sub-frames, moves a scan start time of the first sub-frame of the second group to between a scan start time of the first sub-frame and a scan start time of the second sub-frame of the first group, moves a scan start time of the first sub-frame of the third group to between a scan start time of the second sub-frame and a scan start time of the third sub-frame of the second group, moves a scan start time of the first sub-frame of the fourth group to between a scan start time of the first sub-frame and a scan start time of the second sub-frame of the third group, moves a scan start time of the fourth sub-frame of the fifth group to between a scan start time of the first sub-frame and a scan start time of the second sub-frame of the fourth group, moves a scan start time of the first sub-frame of the sixth group to between a scan start time of the fifth sub-frame and a scan start time of a blank sub-frame of the fifth group, moves a scan start time of the fourth sub-frame of the seventh group to between a scan start time of the second sub-frame and a scan start time of the third sub-frame of the sixth group, moves a scan start time of the fifth sub-frame of the eighth group to between a scan start time of the third sub-frame and a scan start time of the fourth sub-frame of the seventh group, moves a scan start time of the fourth sub-frame of the ninth group to between a scan start time of the first sub-frame and a scan start time of the second sub-frame of the eighth group, and moves a scan start time of the first sub-frame of the tenth group to between a scan start time of the second sub-frame and a scan start time of the third sub-frame of the ninth group.

The timing controller may order the light emission period before the blank period in sub-frames of the first to third groups, orders the blank period before the light emission period in sub-frames of the fourth and fifth groups, moves a scan start time of the first sub-frame of the fifth group to between a scan start time of the first sub-frame and a scan start time of the second sub-frame of the fourth group, moves a scan start time of the first sub-frame of the second group to between a scan start time of the fourth sub-frame and a scan start time of the fifth sub-frame of the first group, moves a scan start time of the first sub-frame of the third group to between a scan start time of the third sub-frame and a scan start time of the fourth sub-frame of the second group, moves a scan start time of the first sub-frame of the fourth group to between a scan start time of the fifth sub-frame of the previous frame and a scan start time of a blank sub-frame of the third group, moves a scan start time of the first sub-frame of the fifth group to between a scan start time of the first sub-frame and a scan start time of the second sub-frame of the fourth group, orders the blank period before the light emission period in sub-frames of the eighth to tenth groups, orders the light emission period before the blank period in sub-frames of the sixth and seventh groups, moves a scan start time of the first sub-frame of the sixth group to between a scan start time of the third sub-frame and a scan start time of the fourth sub-frame of the fifth group, moves a scan start time of the third sub-frame of the eighth group to between a scan start time of the second sub-frame and a scan start time of the third sub-frame of the seventh group, and moves a scan start time of the second sub-frame of the ninth group to between a scan start time of the second sub-frame and a scan start time of the third sub-frame of the eighth group.

In addition, according to the exemplary embodiment of the invention, the timing controller may control the order of sub-frames of the first to third groups to be a light emission period and a blank period, orders the blank period before the light emission period in sub-frames of the fourth and fifth groups, moves a scan start time of the first sub-frame of the fifth group to between a scan start time of the second sub-frame and a scan start time of the third sub-frame of the fourth group, orders the blank period before the light emission period in sub-frames of the eighth to tenth groups, orders the light emission period before the blank period of sub-frames of the sixth and seventh groups, and moves a scan start time of the fourth sub-frame of the sixth group to between a scan start time of the first sub-frame and a scan start time of the second sub-frame of the fifth group.

Further, the timing controller may control the order of sub-frames of the first to third groups to be a light emission period and a blank period, orders the blank period before the light emission period in sub-frames of the fourth and fifth groups, moves a scan start time of the first sub-frame of the fifth group to between a scan start time of the second sub-frame and a scan start time of the third sub-frame of the fourth group, orders the blank period before the light emission period in sub-frames of the eighth to tenth groups, orders the light emission period before the blank period in sub-frames of the sixth and seventh groups, and moves a scan start time of the fourth sub-frame of the sixth group to between a scan start time of the first sub-frame and a scan start time of the second sub-frame of the fifth group.

In addition, the timing controller may orders the light emission period before the blank period in sub-frames of the first to third groups, orders the blank period before the light emission period in sub-frames of the fourth and fifth groups, moves a scan start time of the first sub-frame of the fifth group to between a scan start time of the second sub-frame and a scan start time of the third sub-frame of the fourth group, orders the blank period before the light emission period in sub-frames of the eighth to tenth groups, orders the light emission period before the blank period in sub-frames of the sixth and seventh groups, and moves a scan start time of the fourth sub-frame of the sixth group to between a scan start time of the first sub-frame and a scan start time of the second sub-frame of the fifth group.

The controller may order the light emission period before the blank period in the sub-frames of the first to fifth groups, controls a light emission period of the first group to be the shortest and a light emission period of the fifth group to be the longest, orders the blank period before the light emission period in sub-frames of the sixth to tenth groups, and controls a light emission of the tenth group to be the shortest and a light emission period of the sixth group to be the longest.

The timing controller may order the light emission period before the blank period in sub-frames of the first to third groups, orders the blank period before the light emission period in sub-frames of the fourth and fifth groups, orders the blank period before the light emission period in sub-frames of the eighth to tenth groups, and orders the light emission period before the blank period in the sub-frames of the sixth and seventh groups.

In addition, a method for driving a display device according to another exemplary embodiment of the invention includes (a) dividing an area of a display unit into an upper portion, a bottom portion, and a center portion, (b) dividing the upper portion into at least first to third groups, the center portion into at least fourth to seventh groups, and the bottom portion into at least eighth to tenth groups, and (c) dividing one frame time into a plurality of sub-frames of a light emission period and a blank sub-frame of a blank period that supplies a black data signal, differentiating a scan start time of light emission sub-frames and a scan start time of the blank sub-frame of the first to tenth groups, and increasing the light emission period and decreasing the blank period in proportional to an increase ratio of the light emission period as close to the center portion from the bottom portion.

In addition, the (c) of the method for driving the display device according to the exemplary embodiment of the invention includes ordering the light emission period before the blank period in the plurality of sub-frames, sequentially delaying scan start times of the second to fifth groups with reference to a scan start time of the first sub-frame of the first group, and sequentially delaying scan start times of the seventh to tenth groups with reference to a scan start time of the first sub-frame of the sixth group.

The (c) of the method for driving the display device according to the exemplary embodiment of the invention includes ordering the light emission period before the blank period in the plurality of sub-frames, moving a scan start time of the first sub-frame of the second group to between a scan start time of the first sub-frame and a scan start time of the second sub-frame of the first group, moving a scan start time of the first sub-frame of the third group to between a scan start time of the second sub-frame and a scan start time of the third sub-frame of the second group, moving a scan start time of the first sub-frame of the fourth group to between a scan start time of the first sub-frame and a scan start time of the second sub-frame of the third group, moving a scan start time of the fourth sub-frame of the fifth group to between a scan start time of the first sub-frame and a scan start time of the second sub-frame of the fifth group, moving a scan start time of the first sub-frame of the sixth group to between a scan start time of the fifth sub-frame and a scan start time of a blank sub-frame of the fifth group, moving a scan start time of the fourth sub-frame of the seventh group to between a scan start time of the second sub-frame and a scan start time of the third sub-frame of the sixth group, moving a scan start time of the fifth sub-frame of the eighth group to between a scan start time of the third sub-frame and a scan start time of the fourth sub-frame of the seventh group, moving a scan start time of the fourth sub-frame of the ninth group to between a scan start time of the first sub-frame and a scan start time of the second sub-frame of the eighth group, and a scan start time of the first sub-frame of the tenth group to between a scan start time of the second sub-frame and a scan start time of the third sub-frame of the ninth group.

Further, the (c) of the method for driving the display device according to the exemplary embodiment of the invention includes ordering the light emission period before the blank period in the sub-frames of the first to third groups, ordering the blank period before the light emission period in sub-frames of the fourth and fifth group, moving a scan start time of the fifth sub-frame of the fifth group to between a scan start time of the first sub-frame and a scan start time of the second sub-frame of the fourth group, ordering the blank period before the light emission period in sub-frames of the eighth to tenth groups, ordering the light emission period before the blank period in sub-frames of the sixth and seventh groups, and moving a scan start time of the first sub-frame of the sixth group to between a scan start time of the last sub-frame of the previous frame and a scan start time of the first sub-frame of the present frame of the fifth group.

In addition, the (c) of the method for driving the display device according to the exemplary embodiment of the invention includes ordering the light emission period before the blank period in sub-frames of the first to third groups, ordering the blank period before the light emission period in sub-frames of the fourth and fifth groups, moving a scan start time of the first sub-frame of the second group to between a scan start time of the fourth sub-frame and a scan start time of the fifth sub-frame of the first group, moving a scan start time of the first sub-frame of the third group to between a scan start time of the third sub-frame and a scan start time of the fourth sub-frame of the second group, moving a scan start time of the first sub-frame of the fourth group to between a scan start time of the fifth sub-frame of the previous frame and a scan start time of a blank sub-frame of the third group, moving a scan start time of the first sub-frame of the fifth group to between a scan start time of the first sub-frame and a scan start time of the second sub-frame of the fourth group, ordering the blank period before the light emission period in sub-frames of the eighth to tenth groups, ordering the light emission period before the blank period in sub-frames of the sixth and seventh groups, moving a scan start time of the first sub-frame of the sixth group to between a scan start time of the third sub-frame and a scan start time of the fourth sub-frame of the fifth group, moving a scan start time of the third sub-frame of the eighth group to between a scan start time of the second sub-frame and a scan start time of the third sub-frame of the seventh group, moving a scan start time of the second sub-frame of the ninth group to between a scan start time of the second sub-frame and a scan start time of the third sub-frame of the eighth group.

In addition, the (c) of the method for driving the display device according to the exemplary embodiment of the invention includes ordering the light emission period before the blank period in sub-frames of the first to third groups, ordering the blank period before the light emission period in sub-frames of the fourth and fifth groups, moving a scan start time of the first sub-frame of the fifth group to between a scan start time of the second sub-frame and a scan start time of the third sub-frame of the fourth group, ordering the blank period before the light emission period in sub-frames of the eight to tenth groups, ordering the light emission period before the blank period in sub-frames of the sixth and seventh groups, and moving a scan start time of the fourth sub-frame of the sixth group to between a scan start time of the first sub-frame and a scan start time of the second sub-frame of the fifth group.

In addition, the (c) of the method for driving the display device according to the exemplary embodiment of the invention includes ordering the light emission period before the blank period in sub-frames of the first to third groups, ordering the blank period before the light emission period in sub-frames of the fourth and fifth groups, moving a scan start time of the first sub-frame of the fifth group to between a scan start time of the second sub-frame and a scan start time of the third sub-frame of the fourth group, ordering the blank period before the light emission period in sub-frames of the eighth to tenth groups, ordering the light emission period before the blank period in sub-frames of the sixth and seventh groups, and moving a scan start time of the fourth sub-frame of the sixth group to between a scan start time of the first sub-frame and a scan start time of the second sub-frame of the fifth group.

In addition, the (c) of the method for driving the display device according to the exemplary embodiment of the invention includes ordering the light emission period before the blank period in sub-frames of the first to fifth groups, controlling the light emission period of the first period to be the shortest and the light emission period of the fifth group to be the longest, ordering the blank period before the light emission period in the sub-frames of the sixth to tenth groups, and controlling the light emission period of the tenth group to be the shortest and the light emission period of the sixth group to be the longest.

In addition, the (c) of the method for driving the display device according to the exemplary embodiment of the invention includes ordering the light emission period before the blank period in the sub-frames of the first to third groups, ordering the blank period before the light emission period in sub-frames of the fourth and fifth groups, ordering the blank period before the light emission period in the sub-frames of the eighth to tenth groups, and ordering the light emission period before the blank period in the sub-frames of the sixth and seventh groups.

According to an exemplary embodiment of the invention, panel luminance imbalance caused by a voltage drop in a power line of a display device can be effectively solved.

DETAILED DESCRIPTION

Figure 1:
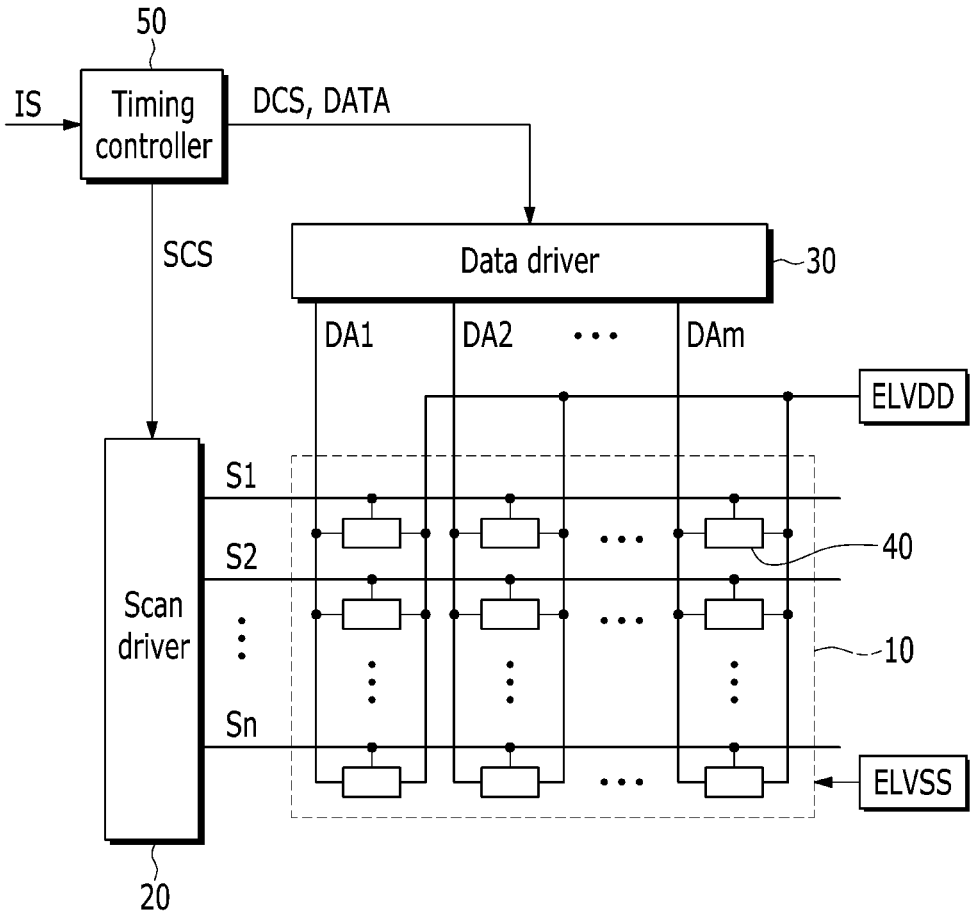
FIG. 1 shows a display device according to an exemplary embodiment of the invention.

Typically, a power line is extended due to a size increase of an organic light emitting diode ("OLED") display and the number of OLED is increased so that a current supplied to each power line is increased, thereby causing an increase of a dynamic or static voltage drop (IR drop) in a power line.

Since a data voltage is applied to each pixel of a display device when the OLED display is driven using the digital driving method, a characteristic variation of a thin film transistor ("TFT") may affect uniformity of a TFT-based display device.

The digital driving of the OLED display requires that all the OLEDs receive the same voltage during a light emission period and the voltage is not changed depending on a location of the OLED. However, a voltage drop in a power line causes a voltage difference between an OLED disposed in an upper or a lower portion of a panel and an OLED disposed in a center portion of the panel.

Accordingly, image distortion occurs due to such a voltage difference in the light emission period.

Hereinafter, embodiments of the invention will be described in detail with reference to the accompanying drawings so that those skilled in the art to which the invention pertains may easily practice the invention. As those skilled in the art would realize, the described embodiments may be modified in various different ways, all without departing from the spirit or scope of the invention. The drawings and description are to be regarded as illustrative in nature and not restrictive. Like reference numerals designate like elements throughout the specification.

In addition, unless explicitly described to the contrary, the word "comprise" and variations such as "comprises" or "comprising", will be understood to imply the inclusion of stated elements but not the exclusion of any other elements. In addition, the terms "-er", "-or" and "module" described in the specification mean units for processing at least one function and operation and can be implemented by hardware components or software components and combinations thereof.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

FIG. 1 shows a display device according to an exemplary embodiment of the invention.

Referring to FIG. 1, a display device according to an exemplary embodiment of the invention includes a display unit 10 including a plurality of pixels 40 respectively connected to a plurality of scan lines S1 to Sn and a plurality of data lines DA1 to DAm, a scan driver 20 driving the respective scan lines by supplying a scan signal to the plurality of scan lines S1 to Sn, a data driver 30 driving the respective data lines by supplying a data signal to the plurality of data lines DA1 to DAm, and a timing controller 50 controlling the scan driver 20 and the data driver 30.

The timing controller 50 generates a data driving control signal DCS and a scan driving control signal SCS corresponding to externally supplied synchronization signals. The data driving control signal DCS generated by the timing controller 50 is supplied to the data driver 30 and the scan driving control signal SCS is supplied to the scan driver 20.

In addition, the timing controller 50 converts an externally supplied image signal IS to an image data signal DATA and supplies the image data signal DATA to the data driver 30.

Figure 4:
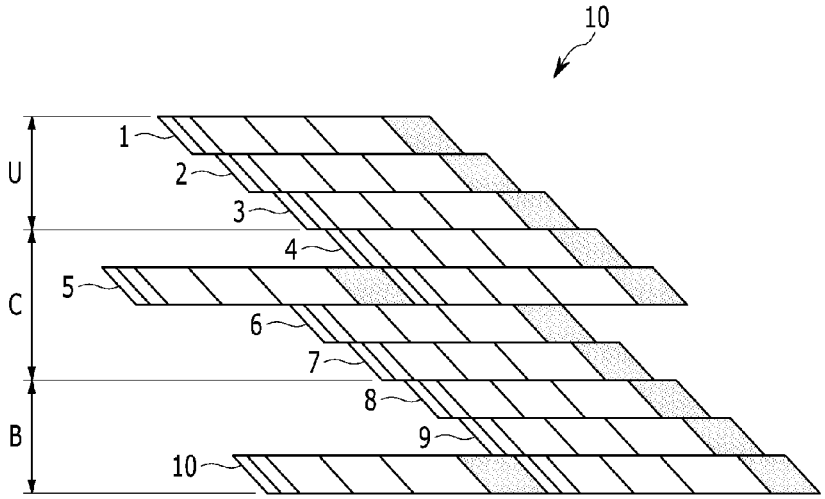
FIG. 4 shows a driving method of a display device according to an exemplary embodiment of the invention.

The timing controller 50 divides an area of the display unit 10 into an upper portion U, a center portion C, and a bottom portion B (refer to FIG. 4). Each area includes at least one of pixel lines where the plurality of pixels 40 is arranged in a horizontal direction.

The timing controller 50 divides the upper portion U into a first group 1, a second group 2, and a third group 3, the center portion C into a fourth group 4, a fifth group 5, a sixth group 6, and a seventh group 7, and the bottom portion B into an eighth group 8, a ninth group 9, and a tenth group 10 (refer to FIG. 4). Each of the first to tenth groups includes at least one of pixel lines where the plurality of pixels 40 is arranged in a horizontal direction.

The timing controller 50 divides one frame into a plurality of sub-frames, and generates an image data signal corresponding to a blank sub-frame which is a black image display period as a black image data signal from a termination time point of a light emission sub-frame which is an image display period.

The black image data signal is an image data signal that does not supply a current to an OLED to effetely prevent light emission of a pixel.

The timing controller 50 differentiates a light emission sub-frame scan start time and a blank sub-frame scan start time for supplying a black data signal of each of the first to tenth groups 1 to 10.

The timing controller 50 moves a scan start time of each sub-frame of the upper portion U, the center portion C, and the bottom portion B in a manner that an increase ratio of the light emission period L (refer to FIG. 3) is increased as a group is closer to the fifth group 5 or the sixth group 6 of the center portion C. Therefore, luminance imbalance due to a voltage drop that frequently occurs as a group is closer to the center portion C can be effectively reduced.

The first sub-frame scan start times of the respective group do not overlap each other, and the degree of movement of the first sub-frame scan start time of each group, controlled by the timing controller 50 may be controlled by a scan movement controller (not shown).

The timing controller 50 effetely prevents a blank period BL (refer to FIG. 3) of the upper portion U and the blank period BL of the bottom portion B from being simultaneously occurred with a light emission period L of the center portion C such that the upper portion U and the bottom portion B do not consume a current while the center portion C consumes a current for light emission, thereby effectively reducing luminance imbalance due to a voltage drop.

The data driver 30 supplies a plurality of data signals to the plurality of data lines DA1 to DAm for each of the plurality of sub-frame periods included in one frame. In further detail, the data driver 30 generates data signals of the first to tenth groups according to the image data signals of the first to tenth groups for each line, and transmits the data signal to the plurality of data lines DA1 to DAm according to the data driving control signal DCS.

The data driver 30 generates a plurality of black data signals corresponding to a black image data signal for each line and transmits the black data signals to the plurality of data lines DA1 to DAm according to the data driving control signal DCS.

In further detail, the data driver 30 is synchronized at a time that a scan signal having a gate-on voltage is supplied corresponding to each sub-frame, and transmits a plurality of data signals that controls light emission of each of the plurality of pixels 40 through the plurality of data lines DA1 to DAm. Here, the gate-on voltage implies a level that turns on a switching transistor to transmit a data signal to a gate electrode of a driving transistor that transmits a driving current to an OLED. This will be described in further detail with reference to a pixel structure of FIG. 2.

The scan driver 20 supplies a scan signal having the gate-on voltage synchronized by a scan start signal of each sub-frame among the scan driving control signal SCS to the corresponding scan line among the plurality of scan lines S1 to Sn. A pixel 40 connected to the scan line among the plurality of scan lines S1 to Sn to which the scan signal having the gate-on voltage is selected by the scan signal. The plurality of pixels 40 selected by the scan signals receive an image data signal or a black data signal according to the corresponding sub-frame from the plurality of data lines DA1 to DAm. In this case, the corresponding sub-frame implies a sub-frame corresponding to the scan signal having the gate-on voltage.

A first power source ELVDD and a second power source ELVSS supply two driving voltages required for driving of the plurality of pixels 40. The two driving voltages include a high-level first driving voltage supplied from the first power source ELVDD and a low-level second driving voltage supplied from the second power source ELVSS.

Figure 2:
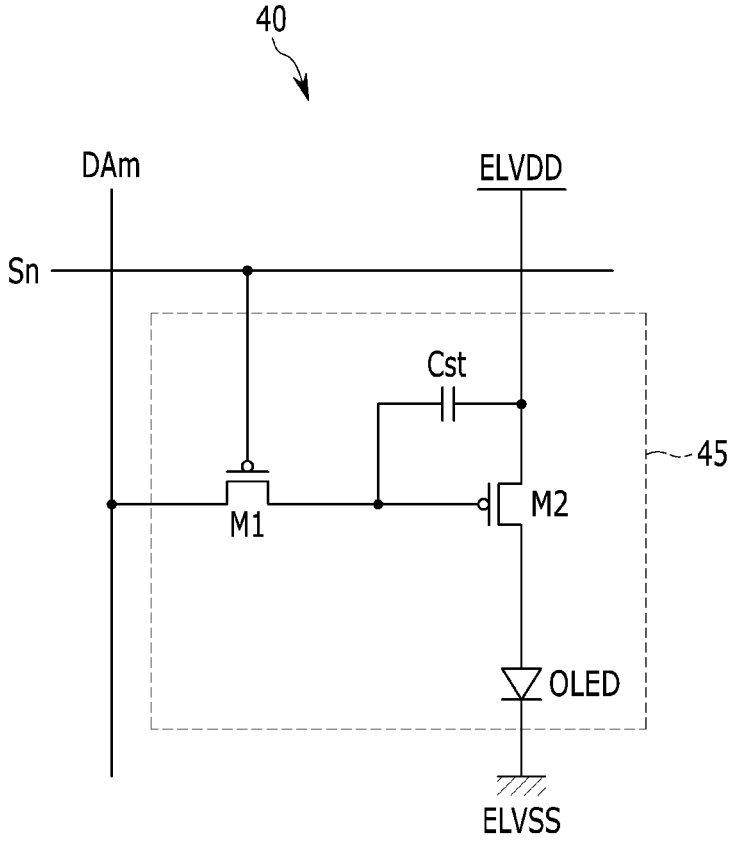
FIG. 2 shows a pixel circuit according to an exemplary embodiment of the invention.

FIG. 2 shows an exemplary embodiment of a pixel circuit according to the invention.

Referring to FIG. 2, a pixel circuit 45 includes a switching transistor M1, a driving transistor M2, a storage capacitor Cst and an OLED. FIG. 2 illustrates an exemplary embodiment of a driving circuit of a pixel, and therefore the invention is not limited thereto. Any structure of a pixel circuit known in the field can be variously applied.

The pixel circuit 45 according to the exemplary embodiment of FIG. 2 includes a switching transistor M1 including a gate electrode connected to the corresponding scan line among the plurality of scan line S1 to Sn, a source electrode connected to the corresponding data line among the plurality of data lines DA1 to DAm, and a drain electrode connected to a node where a first end of the storage capacitor Cst and a gate electrode of the driving transistor M2.

In addition, the pixel circuit 45 includes the driving transistor M2 including a gate electrode connected to the drain electrode of the switching transistor M1, a source electrode connected to the first power source ELVDD, and a drain electrode connected to an anode of the OLED.

The first end of the storage capacitor Cst is connected to the node where the drain electrode of the switching transistor M1 and the gate electrode of the driving transistor M2 are connected, and a second end of the storage capacitor Cst is connected to a source electrode of the driving transistor M2 such that a voltage difference between the gate electrode and the source electrode of the driving transistor M2 is maintained for a sub-frame period.

The anode of the OLED is connected to the drain electrode of the driving transistor M2 and a cathode is connected to the second power source ELVSS.

When the switching transistor M1 is turned on by a scan signal transmitted through the corresponding scan line, a data signal transmitted through the turn-on switching transistor M1 is transmitted to the gate electrode of the driving transistor M2. Thus, the voltage difference between the gate electrode and the source electrode of the driving transistor M2 corresponds to a voltage difference between the data signal and the first driving voltage of the first power source ELVDD, and a driving current flows to the driving transistor M2 according to the corresponding voltage difference.

The driving current is transmitted to the OLED, and the OLED emits light according to the transmitted driving current.

When a plurality of scan signals having the gate-on voltage is supplied to the corresponding scan line among the plurality of scan lines S1 to Sn, a plurality of switching transistors M1 connected to the corresponding scan line are turned on. Each of the plurality of data lines DA1 to DAm is synchronized at a time that the scan signal having the gate-on voltage is supplied and thus receives one of the data signal and the black data signal.

One of the data signal and the black data signal transmitted to the plurality of data lines DA1 to DAm through each of the turn-on switching transistors M1 is transmitted to the driving transistor M2 of each of the plurality of pixels 40 so that the OLED of each of the plurality of pixels 40 emits light or does not emit light during the corresponding sub-frame period according to the transmitted data signal.

Figure 3:
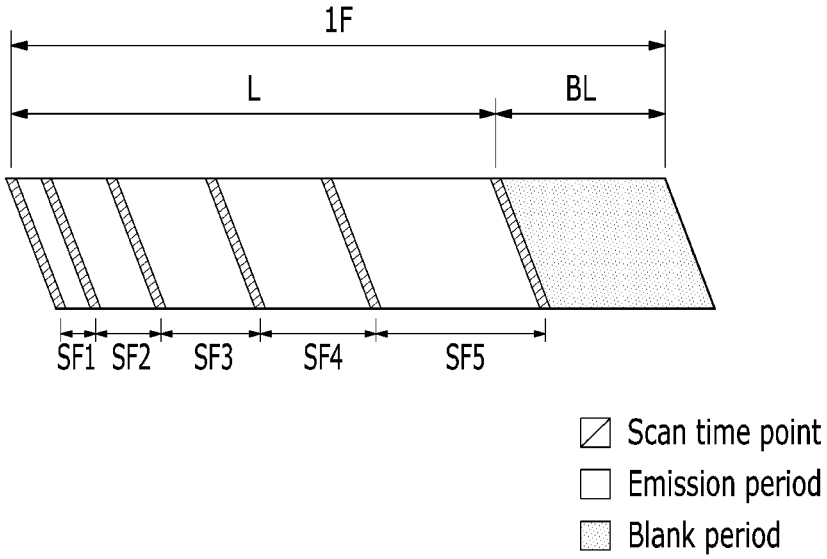
FIG. 3 shows a driving method of a display device according to an exemplary embodiment of the invention.

FIG. 3 shows an exemplary embodiment of a driving method of the display device according to the invention.

One frame 1F according to an exemplary embodiment of the invention may include a light emission period L including a plurality of sub-frames SF1 to SF5 and a sub-frame of the blank period BL. Thus, one frame 1F may include six sub-frames.

The light emission period L includes a scan period during which the plurality of scan signals having the gate-on voltage are synchronized at a start time of each sub-frame and thus sequentially transmitted to the plurality of scan lines S1 to Sn. In this case, when the plurality of scan signals area is transmitted, the data signals are transmitted to the respective pixels through the plurality of data lines DA1 to DAm. Then, the OLED of each of the plurality of pixels emits light during the corresponding sub-frame such that the display unit 10 displays an image.

The blank period BL provided after the light emission period L includes a scan period during which the plurality of scan signals having the gate-on voltage are synchronized at a start time of the blank period BL and thus sequentially transmitted to the plurality of scan lines S1 to Sn. In this case, since the plurality of black data signals is transmitted to the respective pixels during the corresponding sub-frame through the plurality of data lines, the OLED of each of the plurality of pixels does not emit light.

FIG. 4 shows a driving method of the display device according to an exemplary embodiment of the invention.

In FIG. 4, a plurality of blocks arranged from top to bottom in the scan lines of 10 groups 1 to 10 represent a plurality of sub-frames corresponding to the respective scan lines, arranged in time order.

FIG. 4 is a driving waveform illustrating a driving method of a display device according to an exemplary embodiment of the invention. One frame is 1/60 of a second and includes sub-frames consisting of sub-frames of a light emission period L and a sub-frame of a blank period BL. An order of the sub-frames is set to be a light emission period and a blank period BL.

The timing controller 50 sequentially delays scan start times of the second to fifth groups 2 to 5 with reference to a scan start time of the first sub-frame of the first group 1, and sequentially delays scan start times of the seventh to tenth groups 7 to 10 with reference to a scan start time of the first sub-frame of the sixth group 6.

In one exemplary embodiment, the scan start time of the first sub-frame of the first group 1 is behind the scan start time of the first sub-frame of the sixth group 6. The scan start time of the first sub-frame of the first group 1 may be behind a scan start time of the third sub-frame of the sixth group 6, for example.

Figure 5:
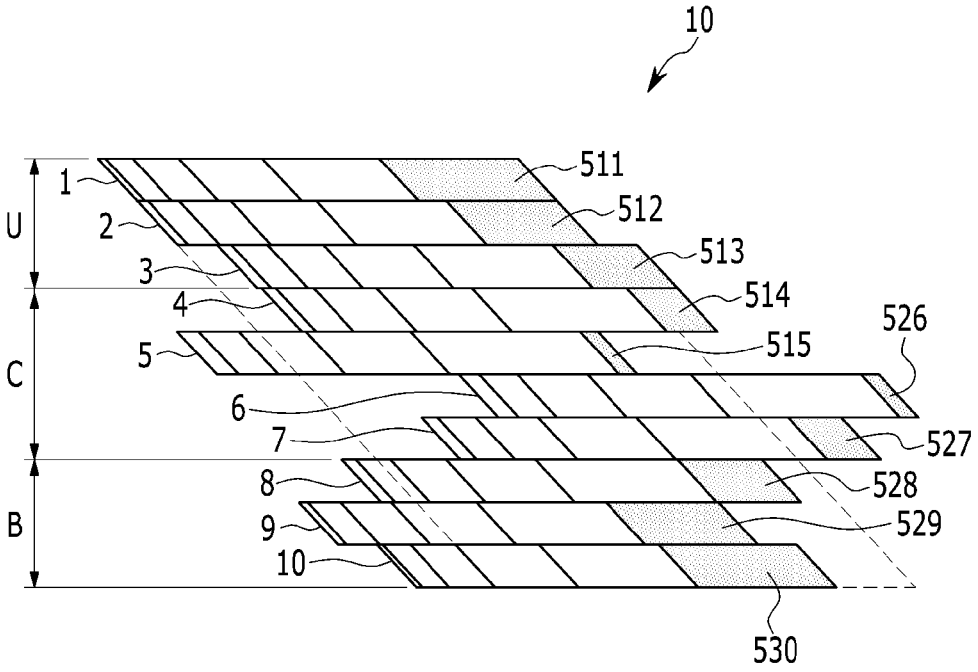
FIG. 5 shows a driving method of a display device according to an exemplary embodiment of the invention.

FIG. 5 shows a driving method of a display device according to another exemplary embodiment of the invention.

FIG. 5 is a driving waveform illustrating a driving method of a display device according to another exemplary embodiment of the invention. One frame period is 1/60 of a second, and includes six sub-frames consisting of sub-frames of a light emission period L and a sub-frame of a blank periods BL. An order of the sub-frames is set to be a light emission period L and a blank period BL. In an exemplary embodiment, first to fifth groups include blank periods 511 to 515, respectively, and sixth to tenth groups include blank periods 526 to 530, respectively.

The timing controller 50 moves a scan start time of the first sub-frame of a second group 2 to a point between a scan start time of the first sub-frame and a scan start time of the second sub-frame of the first group 1 with reference to a scan start time of the first sub-frame of the first group 1. The timing controller 50 moves a scan start time of the first sub-frame of a third group 3 to a point between a scan start time of the second sub-frame and a scan start time of a third sub-frame of the second group 2.

The timing controller 50 moves a scan start time of the first sub-frame of a fourth group 4 between a scan start time of the first sub-frame and a scan start time of the second sub-frame of the third group 3. The timing controller 50 moves a scan start time of the fourth sub-frame of the fifth group 5 to a point between a scan start time of the first sub-frame and the second sub-frame of the fourth group 4. The timing controller 50 moves a scan start time of the first sub-frame of a sixth group 6 to a point between a scan start time of the fifth sub-frame and a scan start time of a blank sub-frame of the fifth group 5. The timing controller 50 moves a scan start time of the fourth sub-frame of a seventh group 7 to a point between a scan start time of the second sub-frame and a scan start time of the third sub-frame of the sixth group 6.

The timing controller 50 moves a scan start time of the fifth sub-frame of an eighth group 8 to a point between a scan start time of the third sub-frame and a scan start time of the fourth sub-frame of the seventh group 7. The timing controller 50 moves a scan start time of the fourth sub-frame of a ninth group 9 to a point between a scan start time of the first sub-frame and a scan start time of the second sub-frame of the eighth group 8. The timing controller 50 moves a scan start time of the first sub-frame of a tenth group 10 to a point between a scan start time of the second sub-frame and a scan start time of the third sub-frame of the ninth group 9.

The timing controller 50 minimizes blank periods BL of the fifth and sixth groups 5 and 6, and increases a blank period BL as a group is closer to the first group 1 with reference to the fifth group 5 and as a group is closer to the tenth group 10 with reference to the sixth group 6.

Figure 6:
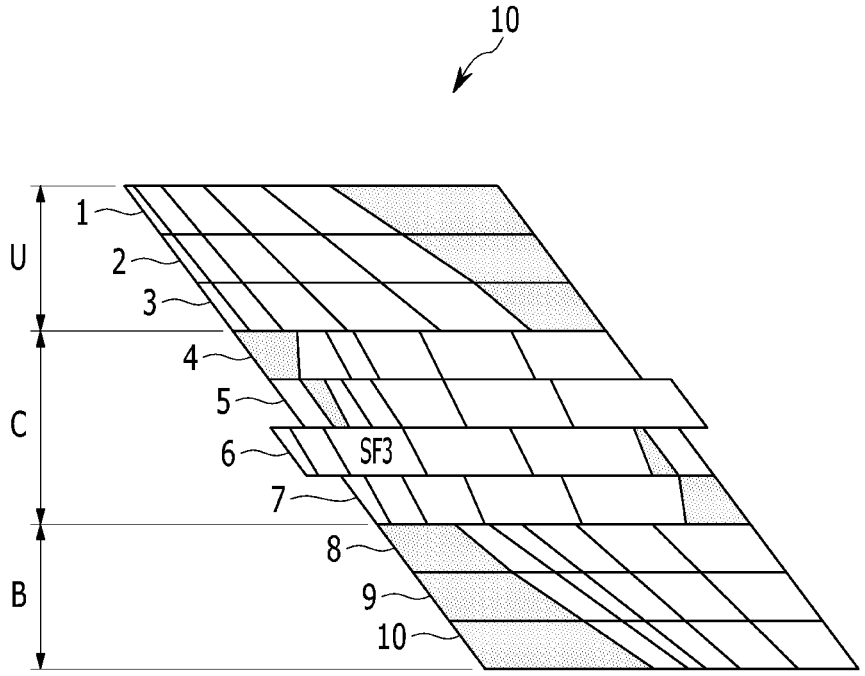
FIG. 6 shows a driving method of a display device according to an exemplary embodiment of the invention.

FIG. 6 shows a driving method of a display device according to another exemplary embodiment of the invention.

FIG. 6 is a waveform diagram illustrating a driving method of a display device according to another exemplary embodiment of the invention. One frame period is 1/60 of a second, and includes six sub-frames consisting of sub-frames of a light emission period L and a sub-frame of a blank periods BL.

A timing controller 50 linearly increases a light emission period L as close to a center portion C from an upper portion U and as close the center portion C from a bottom portion B and linearly decreases a blank period BL in proportional to an increase ratio of the light emission period L.

In further detail, the timing controller 50 controls the order of sub-frames of first to third groups 1 to 3 to be a light emission period L and a blank period BL, and the order of sub-frames of fourth and fifth groups 4 and 5 to be a blank period BL and a light emission period L. The timing controller 50 linearly increases the light emission period toward the fifth group 5 from the firth group 1 and linearly decreases the blank period BL in proportional to an increase ratio of the light emission period L to thereby maximize the light emission period L of the fifth group 5 and minimize the blank period BL of the fifth group 5.

The timing controller 50 moves a scan start time of the first sub-frame of the fifth group 5 to a point between a scan start time of the first sub-frame and a scan start time of the second sub-frame of the fourth group 4.

The timing controller 50 controls the order of sub-frames of eight to tenth groups 8 to 10 to be a blank period and a light emission period L, and controls the order of sub-frames of sixth and seventh groups 6 and 7 to be a light emission period L and a blank period BL. The timing controller 50 linearly increases the light emission period L toward the sixth group 6 from the tenth group 10 and linearly decreases the blank period BL in proportional to an increase ratio of the light emission period L to thereby maximize the light emission period L of the sixth group 6 and minimize the blank period BL of the sixth group 6.

The timing controller 50 moves a scan start time of the third sub-frame of the sixth group 6 to a point between a scan start time of the last sub-frame of the previous frame and the first sub-frame of the present frame of the fifth group 5.

Figure 7:
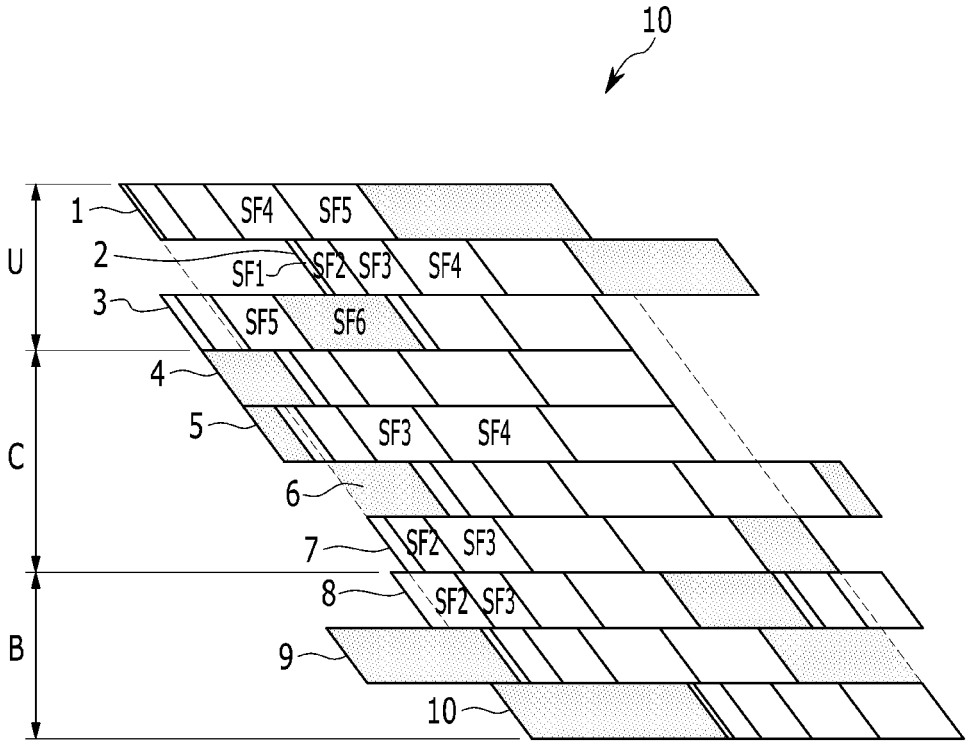
FIG. 7 shows a driving method of a display device according to an exemplary embodiment of the invention.

FIG. 7 shows another exemplary embodiment of a driving method of a display device according to the invention.

FIG. 7 is a driving waveform diagram of the driving method of the display device according to another exemplary embodiment of the invention. One frame is 1/60 of a second, and includes six sub-frames consisting of sub-frames of a light emission period L and a sub-frame of a blank periods BL.

A timing controller 50 increases the light emission period L and decrease the blank period BL in proportional to an increase ratio of the light emission period L as close to a center portion C from an upper portion U and close to the center portion C from a bottom portion B.

In further detail, the timing controller 50 controls an order of sub-frames of first to third group 1 to 3 to be a light emission period L and a blank period BL, and controls an order of sub-frames of fourth and fifth groups 4 and 5 to be a blank period BL and a light emission period L. The timing controller 50 increases the light emission period L and decreases the blank period BL in proportional to an increase ratio of the light emission period L as close to the fifth group 5 from the first group 1 to thereby maximize the light emission period L and minimize the blank period BL of the fifth group 5.

The timing controller 50 moves a scan start time of the first sub-frame of the second group to a point between a scan start time of the fourth sub-frame and a scan start time of the fifth sub-frame of the first group 1. The timing controller 50 moves a scan start time of the first sub-frame of the third group 3 to a point between a scan start time of the third sub-frame and a scan start time of the fourth sub-frame of the second group 2. The timing controller 50 moves a scan start time of the first sub-frame of the fourth group 4 to a point between a scan start time of the fifth sub-frame of the previous frame and a scan start time of a blank sub-frame of the third group 3. The timing controller 50 moves a scan start time of the first sub-frame of the fifth group 5 to a point between a scan start time of the blank sub-frame and a scan start time of the first sub-frame of the fourth group 4.

The timing controller 50 controls an order of sub-frames of eighth to tenth groups 8 to 10 to be a blank period BL and a light emission period L, and controls an order of sub-frames of sixth and seventh groups 6 and 7 to be a light emission period L and a blank period BL. The timing controller 50 increases the light emission period L and decreases the blank period BL in proportional to an increase ratio of the light emission period as close to the sixth group 6 from the tenth group 10 to thereby maximize the light emission period L and the minimize the blank period BL of the sixth group 6.

The timing controller 50 moves a scan start time of the first sub-frame of the sixth group 6 to a point between a scan start time of the third sub-frame and a scan start time of the fourth sub-frame of the fifth group 5. The timing controller 50 moves a scan start time of the third sub-frame of the eighth group 8 to a point between a scan start time of the second sub-frame and a scan start time of the third sub-frame of the seventh group 7. The timing controller 50 moves a scan start time of the second sub-frame of the ninth group 9 to a point between a scan start time of the second sub-frame and a scan start time of the third sub-frame of the eighth group 8.

Figure 8:
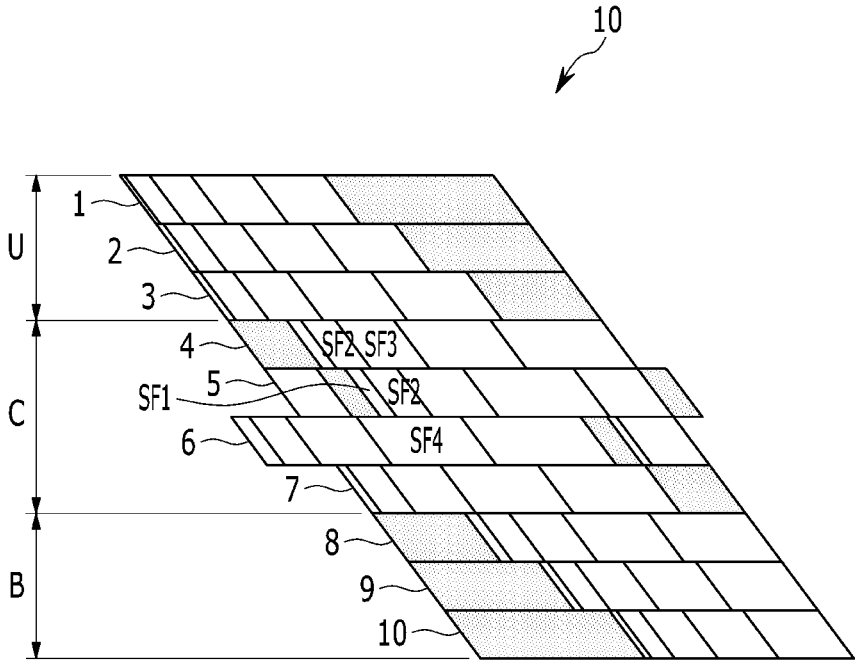
FIG. 8 shows a driving method of a display device according to an exemplary embodiment of the invention.

FIG. 8 shows a driving method of a display device according to another exemplary embodiment of the invention.

FIG. 8 is a driving waveform of the driving method of the display device according to another exemplary embodiment of the invention. One frame is 1/60 of a second, and includes six sub-frames consisting of sub-frames of a light emission period L and a sub-frame of a blank periods BL.

The timing controller 50 increases a light emission period L and decreases a blank period BL in proportional to an increase ratio of the light emission period L as close to a center portion C from an upper portion U and close to the center portion C from a bottom portion C.

In further detail, the timing controller 50 controls an order of sub-frames of first to third groups 1 to 3 to be a light emission period L and a blank period BL, and controls an order of sub-frames of fourth and fifth groups 4 and 5 to be a blank period BL and a light emission period L. The timing controller 50 increases the light emission period L and decreases the blank period BL in proportional to an increase ratio of the light emission period L as close to the fifth group 5 from the first group 1 to thereby maximize the light emission period L and minimize the blank period BL of the fifth group 5.

The timing controller 50 moves a scan start time of the first sub-frame of the fifth group 5 to a point between a scan start time of the second sub-frame and a scan start time of the third sub-frame of the fourth group 4.

The timing controller 50 controls an order of sub-frames of eighth to tenth groups 8 to 10 to be a blank period BL and a light emission period L, and controls an order of sub-frames of sixth and seventh groups 6 and 7 to be a light emission period L and a blank period BL. The timing controller 50 increases the light emission period L and decreases the blank period BL in proportional to an increase ratio of the light emission period as close to the sixth group 6 from the tenth group 10 to thereby maximize the light emission period L and minimize the blank period BL of the sixth group 6.

The timing controller 50 moves a scan start time of the fourth sub-frame of the sixth group 6 to a point between a scan start time of the blank sub-frame and a scan start time of the first sub-frame of the fifth group 5.

Figure 9:
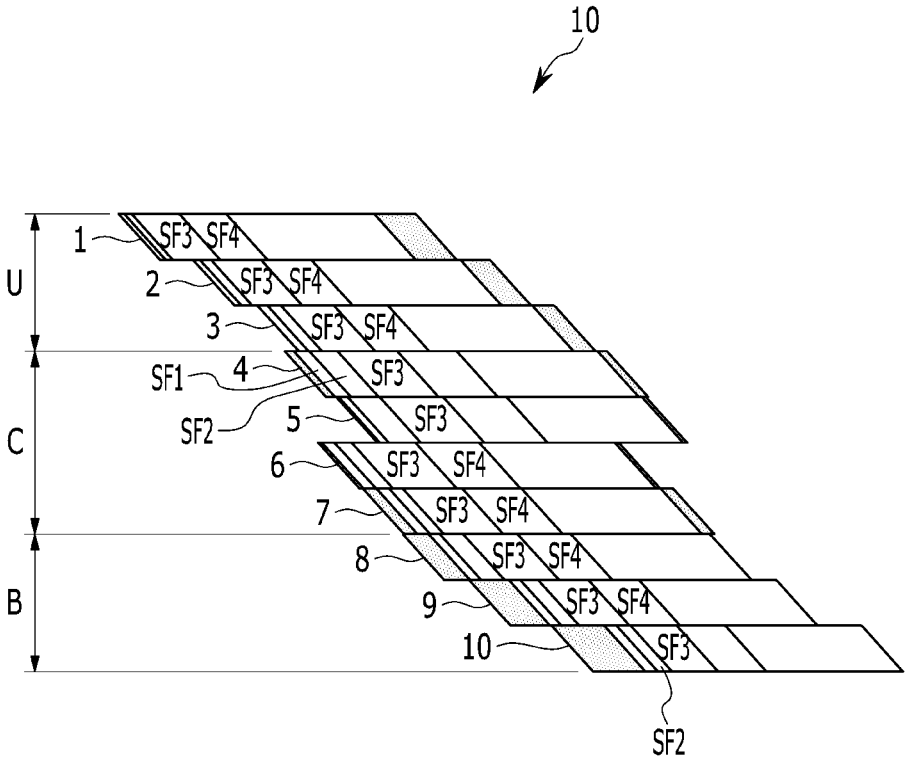
FIG. 9 shows a driving method of a display device according to an exemplary embodiment of the invention.

FIG. 9 shows a driving method of a display device according to another exemplary embodiment of the invention.

FIG. 9 is a driving waveform diagram of the driving method of the display device according to another exemplary embodiment of the invention. One frame is 1/60 of a second, and includes six sub-frames consisting of sub-frames of a light emission period L and a sub-frame of a blank periods BL.

The timing controller 50 increases a light emission period L and decreases a blank period BL in proportional to an increase ratio of the light emission period L as close to a center portion C from an upper portion U and to the center portion C from a bottom portion C.

In further detail, the timing controller 50 controls an order of sub-frames of first to fifth groups 1 to 5 to be a light emission period L and a blank period BL, and increases the light emission period L and decreases the blank period BL in proportional to an increase ratio of the light emission period L as close to the fifth group 5 from the first group 1. Thus, the light emission period L of the first group 1 is the shortest and the light emission period L of the fifth group 5 is the longest. On the contrary, the blank period BL of the first group 1 is the longest and the blank period BL of the fifth group 5 is the shortest.

The timing controller 50 moves a scan start time of the first sub-frame of the second group 2 to a point between a scan start time of the third sub-frame and a scan start time of the fourth sub-frame of the first group 1. The timing controller 50 moves a scan start time of the first sub-frame of the third group 3 to a point between a scan start time of the third sub-frame and a scan start time of the fourth sub-frame of the second group 2. The timing controller 50 moves a scan start time of the third sub-frame of the fourth group 4 to a point between a scan start time of the third sub-frame and a scan start time of the fourth sub-frame of the third group 3. The timing controller 50 moves a scan start time of the first sub-frame of the fifth group 5 to a point between a scan start time of the first sub-frame and a scan start time of the second sub-frame of the fourth group 4.

The timing controller 50 controls an order of sub-frames of sixth to tenth groups 6 to 10 to be a blank period BL and a light emission period L, and increases the light emission period L and decreases the blank period BL in proportional to an increase ratio of the light emission period L as close to the sixth group 6 from the tenth group 10. Thus, the light emission period L of the tenth group 10 is the shortest and the light emission period L of the sixth group 6 is the longest. On the contrary, the blank period BL of the tenth group 10 is the longest and the blank period BL of the sixth group 6 is the shortest.

The timing controller 50 moves a scan start time of the forth sub-frame of the sixth group 6 to a point between a scan start time of the second sub-frame and a scan start time of the third sub-frame of the fifth group 5. The timing controller 50 moves a scan start time of the third sub-frame of the seventh group 7 to a point between a scan start time of the third sub-frame and a scan start time of the forth sub-frame of the sixth group 6. The timing controller 50 moves a scan start time of the third sub-frame of the eighth group 8 to a point between a scan start time of the third sub-frame and a scan start time of the fourth sub-frame of the seventh group 7. The timing controller 50 moves a scan start time of the third sub-frame of the ninth group 9 to a point between a scan start time of the third sub-frame and a scan start time of the forth sub-frame of the eighth group 8. The timing controller 50 moves a scan start time of the second sub-frame of the tenth group 10 to a point between a scan start time of the third sub-frame and a scan start time of the forth sub-frame of the ninth group 9.

Figure 10:
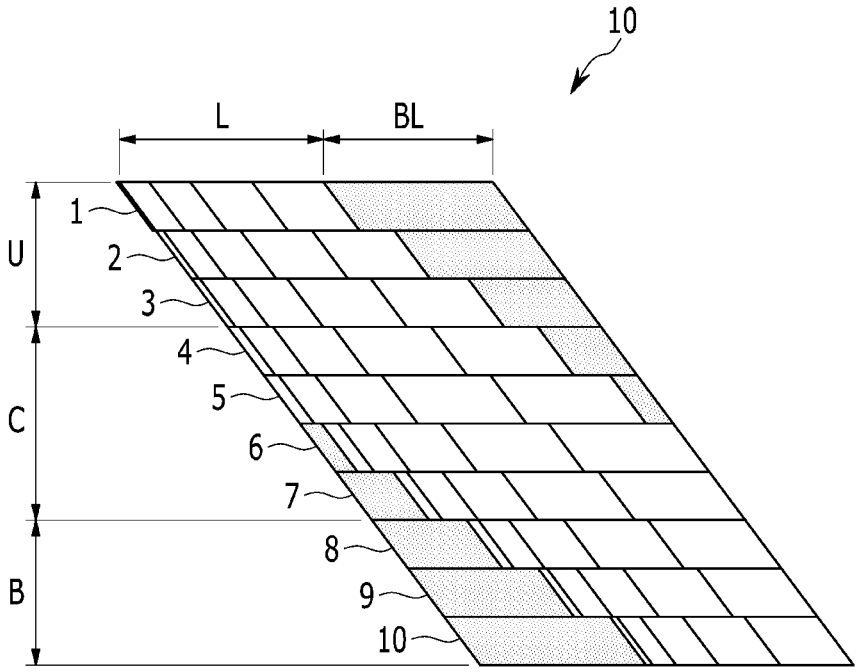
FIG. 10 shows a driving method of a display device according to an exemplary embodiment of the invention.

FIG. 10 shows a driving method of a display device according to another exemplary embodiment of the invention.

FIG. 10 is a driving waveform diagram of the driving method of the display device according to another exemplary embodiment of the invention. One frame is 1/60 of a second, and includes six sub-frames consisting of sub-frames of a light emission period L and a sub-frame of a blank periods BL.

A timing controller 50 increases the light emission period L and decrease the blank period BL in proportional to an increase ratio of the light emission period L as close to a center portion C from an upper portion U and to the center portion C from a bottom portion B.

In further detail, the timing controller 50 controls an order of sub-frames of first to fifth groups 1 to 5 to be a light emission period L and a blank period BL, and increases the light emission period L and decreases the blank period BL in proportional to an increase ratio of the light emission period L as close to the fifth group 5 from the first group 1. Thus, the light emission period L of the first group 1 is the shortest and the light emission period L of the fifth group 5 is the longest. On the contrary, the blank period BL of the first group 1 is the longest and the blank period BL of the fifth group 5 is the shortest.

The timing controller 50 controls an order of sub-frames of sixth to tenth groups 6 to 10 to be a blank period BL and a light emission period L, and increases the light emission period L and decreases the blank period BL in proportional to an increase ratio of the light emission period L as close to the sixth group 6 from the tenth group 10. Thus, the light emission period L of the tenth group 10 is the shortest and the light emission period L of the sixth group 6 is the longest. On the contrary, the blank period BL of the tenth group 10 is the longest and the blank period BL of the sixth group 6 is the shortest.

Figure 11:
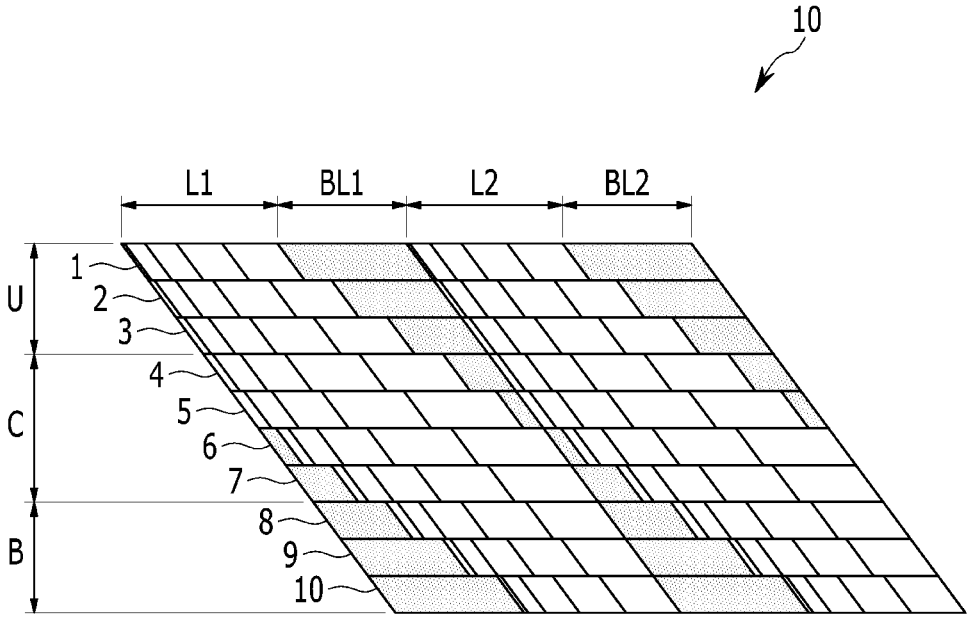
FIG. 11 shows a driving method of a display device according to an exemplary embodiment of the invention.

FIG. 11 shows a driving method of a display device according to another exemplary embodiment of the invention.

FIG. 11 is a driving waveform diagram illustrating the driving method of the display device according to another exemplary embodiment of the invention. One frame is 1/60 of a second, and includes 12 sub-frames consisting of sub-frames of a first light emission period L1, a first blank period BL1, a second light emission period L2 and a second blank period BL2.

The driving method of the display device according to the exemplary embodiment shown in FIG. 11 is the same as that of the exemplary embodiment shown in FIG. 10 except for illustrating two consecutive frames, and therefore no further description will be provided.

Figure 12:
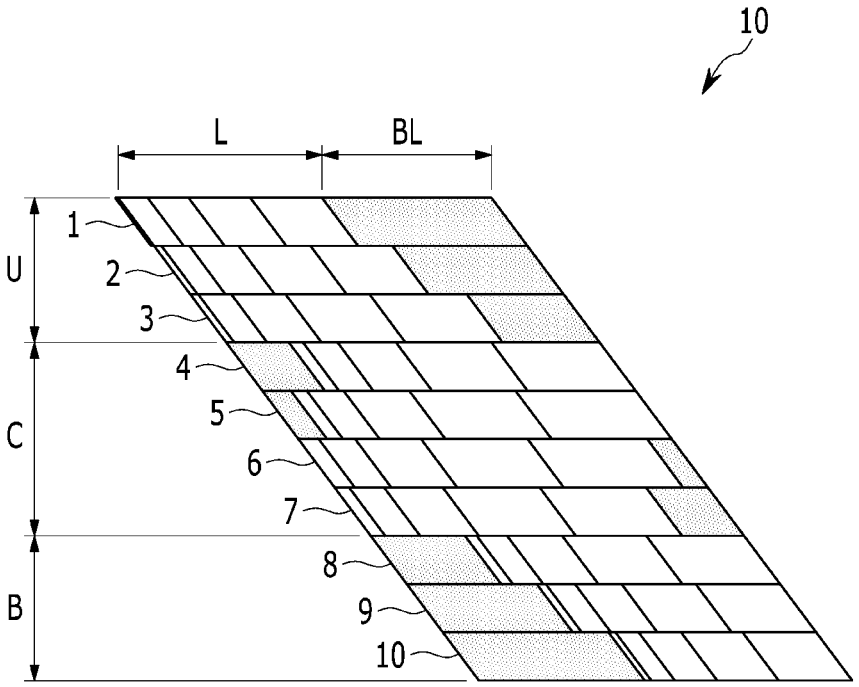
FIG. 12 shows a driving method of the display device according to an exemplary embodiment of the invention.

FIG. 12 shows a driving method of a display device according to another exemplary embodiment of the invention.

FIG. 12 is a driving waveform diagram of the driving method of the display device according to another exemplary embodiment of the invention. One frame is 1/60 of a second, and includes six sub-frames consisting of sub-frames of a light emission period L and a sub-frame of a blank periods BL.

A timing controller 50 increases the light emission period L and decrease the blank period BL in proportional to an increase ratio of the light emission period L as close to a center portion C from an upper portion U and to the center portion C from a bottom portion B.

In further detail, the timing controller 50 controls an order of sub-frames of first to third groups 1 to 3 to be a light emission period L and a blank period BL, and controls an order of sub-frames of fourth and fifth groups 4 and 5 to be a blank period BL and a light emission period L. The timing controller 50 increases the light emission period L and decreases the blank period BL in proportional to an increase ratio of the light emission period L as close to the fifth group 5 from the first group 1 to thereby maximize the light emission period L and minimize the blank period BL of the fifth group 5.

The timing controller 50 controls an order of sub-frames of eighth to tenth groups 8 to 10 to be a blank period BL and a light emission period L, and controls an order of sub-frames of sixth and seventh groups 6 and 7 to be a light emission period L and a blank period BL. The timing controller 50 increases the light emission period L and decreases the blank period BL in proportional to an increase ratio of the light emission period as close to the sixth group 6 from the tenth group 10 to thereby maximize the light emission period L and minimize the blank period BL of the sixth group 6.

Figure 13:
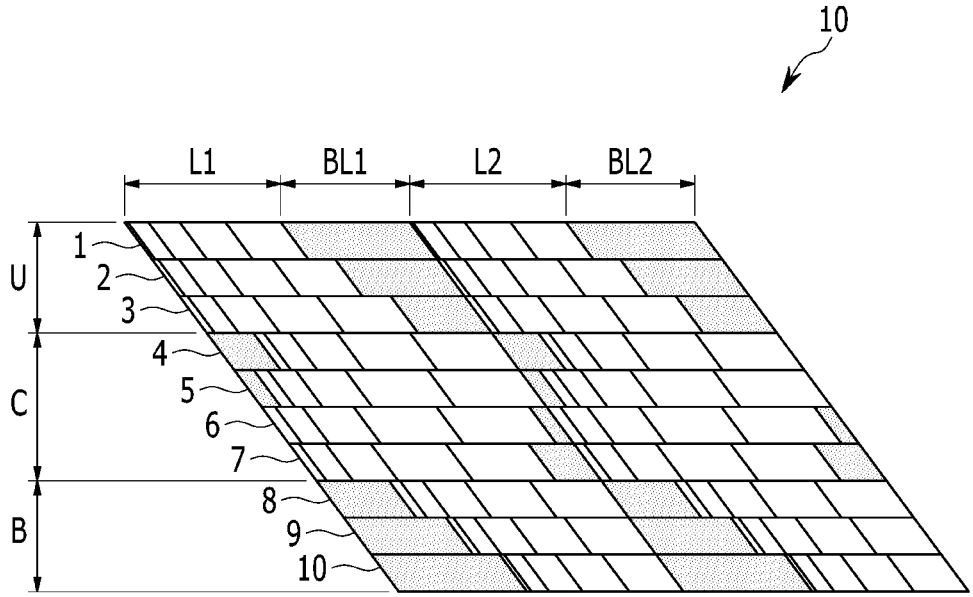
FIG. 13 shows a driving method of the display device according to an exemplary embodiment of the invention.

FIG. 13 shows a driving method of a display device according to another exemplary embodiment of the invention.

FIG. 13 is a driving waveform diagram of the driving method of the display device according to another exemplary embodiment of the invention. One frame is 1/60 of a second, and includes 12 sub-frames consisting of sub-frames of a first light emission period L1, a first blank period BL1, a second light emission period L2 and a second blank period BL2.

The driving method of the display device according to the exemplary embodiment shown in FIG. 13 is the same as that of the exemplary embodiment shown in FIG. 12 except for illustrating two consecutive frames, and therefore no further description will be provided.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the invention.

What is claimed is:

1. A display device comprising:

a display unit including a plurality of pixels, each of which emits light according to each of a plurality of data voltages;

a timing controller which divides an area of the display unit into an upper portion, a center portion and a bottom portion, divides one frame time into a plurality of sub-frames including a plurality of light emission sub-frames of a light emission period and a blank sub-frame of a blank period in which a black data signal is supplied, and generates an image data signal corresponding to each of the plurality of sub-frames; and a data driver which applies a data voltage corresponding to the image data signal to the display unit, wherein the timing controller divides the upper portion into at least three groups including first to third groups, the center portion into at least four groups including fourth to seventh groups, and the bottom portion into at least three groups including eighth to tenth groups, and differentiates a scan start time of a light emission sub-frame and a scan start time of the blank sub-frame of each group, and increases the light emission period of a group of the first to the tenth groups and decrease the blank period of the group of the first to the tenth groups in proportion to an increase ratio of the light emission period as the group of the first to the tenth groups is closer to a middle of the center portion.

2. The display device of claim 1, wherein the timing controller orders the light emission period before the blank period in the plurality of sub-frames, and sequentially delays scan start times of the second to fifth groups with reference to a scan start time of a first sub-frame of the first group and sequentially delays scan start times of the seventh to tenth groups with reference to a scan start time of a first sub-frame of the sixth group.

3. The display device of claim 2, wherein the scan start time of the first sub-frame of the first group is behind the scan start time of the first sub-frame of the sixth group.

4. The display device of claim 1, wherein the timing controller orders the light emission period before the blank period in the plurality of sub-frames, moves a scan start time of a first sub-frame of the second group to a point between a scan start time of a first sub-frame and a scan start time of a second sub-frame of the first group, moves a scan start time of a first sub-frame of the third group to a point between a scan start time of a second sub-frame and a scan start time of a third sub-frame of the second group, moves a scan start time of a first sub-frame of the fourth group to a point between the scan start time of the first sub-frame and a scan start time of a second sub-frame of the third group, moves a scan start time of a fourth sub-frame of the fifth group to a point between the scan start time of the first sub-frame and a scan start time of a second sub-frame of the fourth group, moves a scan start time of a first sub-frame of the sixth group to a point between a scan start time of a fifth sub-frame and a scan start time of a blank sub-frame of the fifth group, moves a scan start time of a fourth sub-frame of the seventh group to a point between a scan start time of a second sub-frame and a scan start time of a third sub-frame of the sixth group, moves a scan start time of the fifth sub-frame of the eighth group to a point between a scan start time of a third sub-frame and the scan start time of the fourth sub-frame of the seventh group, moves a scan start time of a fourth sub-frame of the ninth group to a point between a scan start time of a first sub-frame and a scan start time of a second sub-frame of the eighth group, and moves a scan start time of a first sub-frame of the tenth group to a point between a scan start time of a second sub-frame and a scan start time of a third sub-frame of the ninth group.

5. The display device of claim 1, wherein the timing controller orders the light emission period before the blank period in the plurality of sub-frames of the first to third groups, orders the blank period before the light emission period in the plurality of sub-frames of the fourth and fifth groups, moves a scan start time of a first sub-frame of the fifth group to a point between a scan start time of a first sub-frame and a scan start time of a second sub-frame of the fourth group, and orders the blank period before the light emission period in the plurality of sub-frames of the eighth to tenth groups, orders the light emission period before the blank period in the plurality of sub-frames of the sixth and seventh groups, and moves a scan start time of a first sub-frame of the sixth group to a point between a scan start time of a last sub-frame of a previous frame and a scan start time of the first sub-frame of a present frame of the fifth group.

6. The display device of claim 1, wherein the timing controller orders the light emission period before the blank period in the plurality of sub-frames of the first to third groups, orders the blank period before the light emission period in the plurality of sub-frames of the fourth and fifth groups, and moves a scan start time of a first sub-frame of the second group to a point between a scan start time of a fourth sub-frame and a scan start time of a fifth sub-frame of the first group, moves a scan start time of a first sub-frame of the third group to a point between a scan start time of a third sub-frame and a scan start time of a fourth sub-frame of the second group, moves a scan start time of a first sub-frame of the fourth group to a point between a scan start time of a fifth sub-frame of a previous frame and a scan start time of a blank sub-frame of the third group, and moves a scan start time of a first sub-frame of the fifth group to a point between the scan start time of the first sub-frame and a scan start time of a second sub-frame of the fourth group, and orders the blank period before the light emission period in the plurality of sub-frames of the eighth to tenth groups, orders the light emission period before the blank period in the plurality of sub-frames of the sixth and seventh groups, and moves a scan start time of a first sub-frame of the sixth group to a point between a scan start time of a third sub-frame and a scan start time of a fourth sub-frame of the fifth group, moves a scan start time of a third sub-frame of the eighth group to a point between a scan start time of a second sub-frame and a scan start time of a third sub-frame of the seventh group, and moves a scan start time of a second sub-frame of the ninth group to a point between a scan start time of a second sub-frame and the scan start time of the third sub-frame of the eighth group.

7. The display device of claim 1, wherein the timing controller controls an order of the plurality of sub-frames of the first to third groups to be a light emission period and a blank period, orders the blank period before the light emission period in the plurality of sub-frames of the fourth and fifth groups, and moves a scan start time of a first sub-frame of the fifth group to a point between a scan start time of a second sub-frame and a scan start time of a third sub-frame of the fourth group, and orders the blank period before the light emission period in the plurality of sub-frames of the eighth to tenth groups, orders the light emission period before the blank period in the plurality of sub-frames of the sixth and seventh groups, and moves a scan start time of a fourth sub-frame of the sixth group to a point between a scan start time of a first sub-frame and a scan start time of a second sub-frame of the fifth group.

8. The display device of claim 1, wherein the timing controller orders the light emission period before the blank period in the plurality of sub-frames of the first to third groups, orders the blank period before the light emission period in the plurality of sub-frames of the fourth and fifth groups, and moves a scan start time of a first sub-frame of the fifth group to a point between a scan start time of a second sub-frame and a scan start time of a third sub-frame of the fourth group, and orders the blank period before the light emission period in the plurality of sub-frames of the eighth to tenth groups, orders the light emission period before the blank period in the plurality of sub-frames of the sixth and seventh groups, and moves a scan start time of a fourth sub-frame of the sixth group to a point between the scan start time of the first sub-frame and a scan start time of a second sub-frame of the fifth group.

9. The display device of claim 1, wherein the timing controller orders the light emission period before the blank period in the plurality of sub-frames of the first to fifth groups, and controls a light emission period of the first group to be the shortest and a light emission period of the fifth group to be the longest, and orders the blank period before the light emission period in the plurality of sub-frames of the sixth to tenth groups, and controls a light emission of the tenth group to be a shortest and a light emission period of the sixth group to be a longest.

10. The display device of claim 1, wherein the timing controller orders the light emission period before the blank period in the plurality of sub-frames of the first to third groups, orders the blank period before the light emission period in the plurality of sub-frames of the fourth and fifth groups, orders the blank period before the light emission period in the plurality of sub-frames of the eighth to tenth groups, and orders the light emission period before the blank period in the plurality of sub-frames of the sixth and seventh groups.

11. A method for driving a display device, comprising:

(a) comprising dividing an area of a display unit into an upper portion, a bottom portion and a center portion;

(b) comprising dividing the upper portion into at least three groups including first to third groups, the center portion into at least four groups including fourth to seventh groups, and the bottom portion into at least three groups including eighth to tenth groups; and (c) comprising dividing one frame time into a plurality of sub-frames of a light emission period and a blank sub-frame of a blank period that supplies a black data signal, differentiating a scan start time of light emission sub-frames and a scan start time of the blank sub-frame of the first to tenth groups, and increasing the light emission period of a group of the first to the tenth groups and decreasing the blank period of the group of the first to the tenth groups in proportional to an increase ratio of the light emission period as the group of the first to the tenth groups is closer to a middle of the center portion.

12. The method for driving the display device of claim 11, wherein the (c) further comprises ordering the light emission period before the blank period in the plurality of sub-frames, sequentially delaying scan start times of the second to fifth groups with reference to a scan start time of a first sub-frame of the first group, and sequentially delaying scan start times of the seventh to tenth groups with reference to a scan start time of a first sub-frame of the sixth group.

13. The method for driving the display device of claim 11, wherein the (c) further comprises ordering the light emission period before the blank period in the plurality of sub-frames, moving a scan start time of a first sub-frame of the second group to a point between a scan start time of a first sub-frame and a scan start time of a second sub-frame of the first group, moving a scan start time of a first sub-frame of the third group to between a scan start time of a second sub-frame and a scan start time of a third sub-frame of the second group, moving a scan start time of a first sub-frame of the fourth group to between the scan start time of the first sub-frame and a scan start time of a second sub-frame of the third group, moving a scan start time of a fourth sub-frame of the fifth group to between the scan start time of the first sub-frame and a scan start time of a second sub-frame of the fourth group, moving a scan start time of a first sub-frame of the sixth group to between a scan start time of a fifth sub-frame and a scan start time of a blank sub-frame of the fifth group, moving a scan start time of a fourth sub-frame of the seventh group to between a scan start time of a second sub-frame and a scan start time of a third sub-frame of the sixth group, moving a scan start time of a fifth sub-frame of the eighth group to between a scan start time of a third sub-frame and the scan start time of the fourth sub-frame of the seventh group, moving a scan start time of a fourth sub-frame of the ninth group to between a scan start time of a first sub-frame and a scan start time of a second sub-frame of the eighth group, and moving a scan start time of a first sub-frame of the tenth group to between a scan start time of a second sub-frame and a scan start time of a third sub-frame of the ninth group.

14. The method for driving the display device of claim 11, wherein the (c) further comprises ordering the light emission period before the blank period in the plurality of sub-frames of the first to third groups, ordering the blank period before the light emission period in the plurality of sub-frames of the fourth and fifth group, and moving a scan start time of a fifth sub-frame of the fifth group to between a scan start time of a first sub-frame and a scan start time of a second sub-frame of the fourth group, and ordering the blank period before the light emission period in the plurality of sub-frames of the eighth to tenth groups, ordering the light emission period before the blank period in the plurality of sub-frames of the sixth and seventh groups, and moving a scan start time of a first sub-frame of the sixth group to between a scan start time of a last sub-frame of a previous frame and a scan start time of a first sub-frame of a present frame of the fifth group.

15. The method for driving the display device of claim 11, wherein the (c) further comprises:

ordering the light emission period before the blank period in the plurality of sub-frames of the first to third groups, ordering the blank period before the light emission period in the plurality of sub-frames of the fourth and fifth groups, moving a scan start time of a first sub-frame of the second group to between a scan start time of a fourth sub-frame and a scan start time of a fifth sub-frame of the first group, moving a scan start time of a first sub-frame of the third group to between a scan start time of a third sub-frame and a scan start time of a fourth sub-frame of the second group, moving a scan start time of a first sub-frame of the fourth group to between a scan start time of a fifth sub-frame of a previous frame and a scan start time of a blank sub-frame of the third group, and moving a scan start time of a first sub-frame of the fifth group to between the scan start time of the first sub-frame and a scan start time of a second sub-frame of the fourth group, and ordering the blank period before the light emission period in the plurality of sub-frames of the eighth to tenth groups, ordering the light emission period before the blank period in the plurality of sub-frames of the sixth and seventh groups, moving a scan start time of a first sub-frame of the sixth group to between a scan start time of a third sub-frame and a scan start time of a fourth sub-frame of the fifth group, moving a scan start time of a third sub-frame of the eighth group to between a scan start time of a second sub-frame and a scan start time of a third sub-frame of the seventh group, and moving a scan start time of a second sub-frame of the ninth group to between a scan start time of a second sub-frame and the scan start time of the third sub-frame of the eighth group.

16. The method for driving the display device of claim 11, wherein the (c) further comprises:

ordering the light emission period before the blank period in the plurality of sub-frames of the first to third groups, ordering the blank period before the light emission period in the plurality of sub-frames of the fourth and fifth groups, and moving a scan start time of a first sub-frame of the fifth group to between a scan start time of a second sub-frame and a scan start time of a third sub-frame of the fourth group, ordering the blank period before the light emission period in the plurality of sub-frames of the eight to tenth groups, ordering the light emission period before the blank period in the plurality of sub-frames of the sixth and seventh groups, and moving a scan start time of a fourth sub-frame of the sixth group to between a scan start time of a first sub-frame and a scan start time of a second sub-frame of the fifth group.

17. The method for driving the display device of claim 11, wherein the (c) further comprises:

ordering the light emission period before the blank period in the plurality of sub-frames of the first to third groups, ordering the blank period before the light emission period in the plurality of sub-frames of the fourth and fifth groups, and moving a scan start time of a first sub-frame of the fifth group to between a scan start time of a second sub-frame and a scan start time of a third sub-frame of the fourth group, and ordering the blank period before the light emission period in the plurality of sub-frames of the eighth to tenth groups, ordering the light emission period before the blank period in the plurality of sub-frames of the sixth and seventh groups, and moving a scan start time of a fourth sub-frame of the sixth group to between the scan start time of the first sub-frame and a scan start time of a second sub-frame of the fifth group.

18. The method for driving the display device of claim 11, wherein the (c) further comprises:

ordering the light emission period before the blank period in the plurality of sub-frames of the first to fifth groups, and controlling the light emission period of the first period to be the shortest and the light emission period of the fifth group to be the longest, and ordering the blank period before the light emission period in the plurality of sub-frames of the sixth to tenth groups, and controlling the light emission period of the tenth group to be the shortest and the light emission period of the sixth group to be the longest.

19. The method for driving the display device of claim 11, wherein the (c) further comprises:

ordering the light emission period before the blank period in the plurality of sub-frames of the first to third groups, and ordering the blank period before the light emission period in the plurality of sub-frames of the fourth and fifth groups, and ordering the blank period before the light emission period in the plurality of sub-frames of the eighth to tenth groups, and ordering the light emission period before the blank period in the plurality of sub-frames of the sixth and seventh groups.

* * * * *